US010443231B2

(12) United States Patent
Thomsen et al.

(10) Patent No.: US 10,443,231 B2
(45) Date of Patent: Oct. 15, 2019

(54) SEALING MEMBER FOR USE BETWEEN A FLASHING MEMBER AND A ROOFING MATERIAL, A FLASHING KIT INCLUDING SUCH A SEALING MEMBER, AND A METHOD FOR WEATHER PROOFING THE JOINT BETWEEN A ROOF OF A BUILDING AND A ROOF PENETRATING STRUCTURE

(71) Applicant: VKR Holding A/S, Hørsholm (DK)

(72) Inventors: Carsten Thomsen, Skanderborg (DK); Christian Munk Mikkelsen, Vejle (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 15/777,921

(22) PCT Filed: Nov. 22, 2016

(86) PCT No.: PCT/DK2016/050381
§ 371 (c)(1),
(2) Date: May 22, 2018

(87) PCT Pub. No.: WO2017/088882
PCT Pub. Date: Jun. 1, 2017

(65) Prior Publication Data

US 2018/0347180 A1 Dec. 6, 2018

(30) Foreign Application Priority Data

Nov. 24, 2015 (DK) ..... 2015 70754

(51) Int. Cl.
*E04B 1/68* (2006.01)
*E04D 13/147* (2006.01)
*E06B 1/62* (2006.01)

(52) U.S. Cl.
CPC ..... *E04B 1/6812* (2013.01); *E04D 13/147* (2013.01); *E04D 13/1475* (2013.01); *E06B 2001/626* (2013.01); *E06B 2001/628* (2013.01)

(58) Field of Classification Search
CPC . E04B 1/6812; E04D 13/147; E04D 13/1475; E04D 13/1618; E06B 1/62
See application file for complete search history.

(56) References Cited

U.S. PATENT DOCUMENTS 4,110,881 A * 9/1978 Thompson ..... A47C 27/146 267/145
4,848,051 A * 7/1989 Weisner ..... E04D 13/031 52/200

(Continued)

FOREIGN PATENT DOCUMENTS

DE 2503519 8/1976
DE 202014100478 5/2015

(Continued)

OTHER PUBLICATIONS

International Preliminary Report on Patentability dated Oct. 17, 2017 issued in connection with PCT/DK2016/050381, pp. 1 to 14.

(Continued)

*Primary Examiner* — Paola Agudelo
(74) *Attorney, Agent, or Firm* — Merek, Blackmon & Voorhees, LLC

(57) ABSTRACT

A sealing member for use between a flashing member and a roofing material is made of a compressible material and with slits and/or weakening sections extending into the sealing member from the exterior surface towards the interior surface, each slit and/or weakening section extending from one side surface to the other side surface. In one embodiment the slits and/or weakening sections extend in parallel planes, each plane being substantially parallel to the height direction and extending at an angle of 15-75 degrees to the length (Continued)

Figure 1A:
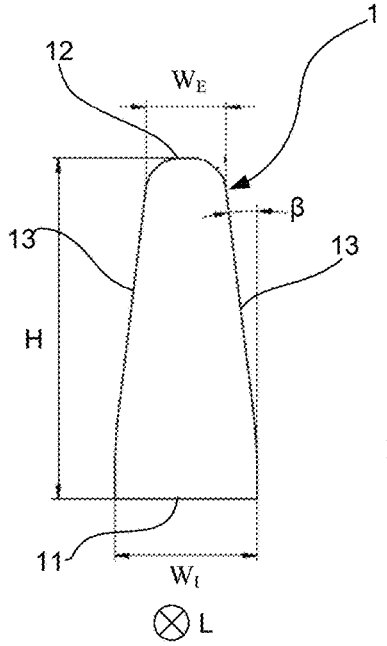

direction of the sealing member, preferably an angle of 45 degrees. In use the sealing member is arranged on a flashing member and a roofing material is arranged to rest on the sealing member and compress one or more sections of the sealing member. If the sealing member includes weakening sections, at least one of these is at least partially broken when the sealing member is compressed.

30 Claims, 8 Drawing Sheets

(56) References Cited

U.S. PATENT DOCUMENTS 5,053,266 A 10/1991 Hesketh et al.
5,426,898 A * 6/1995 Larsen ..... E04D 3/40 428/152
5,522,189 A * 6/1996 Mortensen ..... E04D 13/02 52/200
5,718,088 A * 2/1998 Jacobsen ..... E04D 13/1475 52/200
6,598,356 B1 * 7/2003 Sells ..... E04D 13/174 52/198
2008/0303226 A1 * 12/2008 Deib ..... E04B 1/6812 277/650
2009/0031640 A1 * 2/2009 Elmes ..... E04D 13/02 52/60
2009/0064605 A1 * 3/2009 Hoffman ..... B65G 69/008 52/173.2
2010/0024321 A1 * 2/2010 Scherer ..... E06B 1/62 52/98
2010/0104797 A1 * 4/2010 Deiss ..... E04B 1/6812 428/102
2012/0058309 A1 * 3/2012 Deiss ..... E04B 1/6812 428/158
2017/0198479 A1 * 7/2017 LeVey ..... E04B 1/6812

FOREIGN PATENT DOCUMENTS

| | | |
|---|---|---|
| EP | 0148429 | 7/1985 |
| EP | 0320343 | 6/1989 |
| NL | 1008048 | 7/1999 |
| WO | WO 0/348478 | 6/2003 |
| WO | WO03074812 | 9/2003 |

OTHER PUBLICATIONS

Apr. 15, 2019 Office Action issued in corresponding European Patent Application No. 16801960.2, 4 pages.
Machine generated English translation of EP0320343, 19 pages.
Claims addressed in Apr. 15, 2019 Office Action issued in corresponding European Patent Application No. 16801960.2, 4 pages.

* cited by examiner

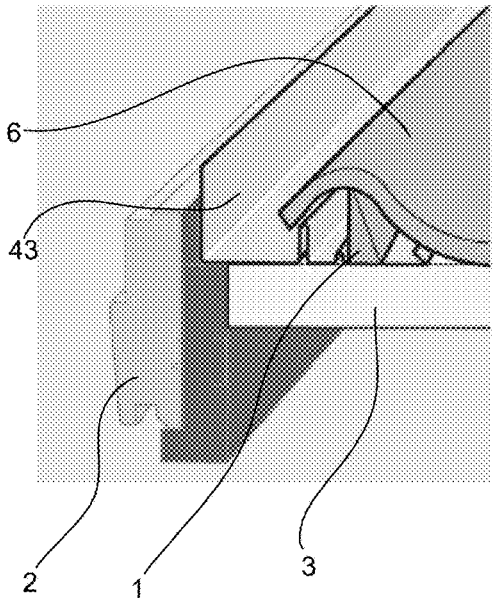
Fig. 6a
Fig. 6b
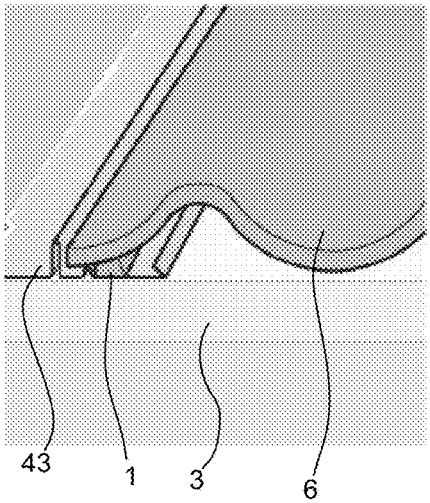
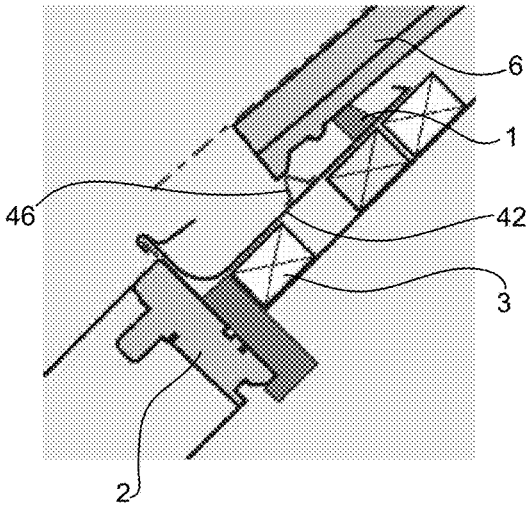
Fig. 7

SEALING MEMBER FOR USE BETWEEN A FLASHING MEMBER AND A ROOFING MATERIAL, A FLASHING KIT INCLUDING SUCH A SEALING MEMBER, AND A METHOD FOR WEATHER PROOFING THE JOINT BETWEEN A ROOF OF A BUILDING AND A ROOF PENETRATING STRUCTURE

The present application is a 371 application of International Application No. PCT/DK2016/050381 filed on Nov. 22, 2016 which claims priority from foreign application No. PA 2015 70754 filed in Denmark on Nov. 24, 2015.

The present invention relates to a sealing member for use between a flashing member and a roofing material, said sealing member comprising an exterior surface adapted for coming into contact with the roofing material, an interior surface adapted for being attached to the flashing member and two side surfaces extending between the exterior surface and the interior surface. The invention further relates to a method for weather proofing the joint between a roof of a building and a roof penetrating structure.

The purpose of such sealing members is to secure tightness where different weather screening building components are to be connected with each other. The primary purpose of tightening the joint between the building components is to weather proof the construction by preventing the ingress of water, snow and wind, but it is also advantageous if the sealing member hinders dirt, leaves and small animals in entering into the construction.

The sealing member is intended primarily for use with windows mounted in an inclined roof structure comprising a load-bearing structure including a plurality of battens and a roofing material arranged on the battens. The joint between the window and the roof structure is weather-proofed by means of a flashing frame, which may be a unitary frame, but which is usually composed of a number of flashing members. Each flashing member/frame typically has a first leg lying substantially in the plane of the roof between the battens and the roofing and a second leg extending at an angle with respect to the first leg and lying substantially parallel to the outer side of the window.

With a view to providing a sealing transition between a flashing and the surrounding roofing material, a sealing member of the kind mentioned in the introduction is connected to the second leg of the flashing. The roofing material is then put on top of the sealing member, which is thus compressed and seals the joint between the flashing and the roofing material.

In case of profiled roofing materials such as undulated tiles, it is necessary that the sealing element has a relatively large extent in the height direction, so that a sealing transition is established even where the sealing member is located under the highest part of the roofing material profile. On the other hand, this implies that large deformation of the sealing member occurs at other places and it happens that gaps are created between the sealing member and the roofing material where water and other types of precipitation can penetrate and seep through to the roof structure located under the roofing material. Such gaps particularly occur where the level of the interior side of the roofing material shifts abruptly, such as for example where one tile overlaps another. In order to avoid such gaps, the height of the sealing element is adapted dependent on the location relative to the profiling of the tiles. This may be done by manual cutting or using pre-defined weakening portions as described in EP1451422A1.

It, however, remains a problem that the adaptation is sometimes forgotten and that the person doing the installation sometimes removes too much material or removes material in the wrong place.

On this background, it is the object of the invention to provide a sealing member of the kind described in the introduction, where said sealing member is universally applicable and makes it possible to obtain improved tightness with all types of roofing materials and at the same time to facilitate the work routine in connection with the installation of the roof penetrating structure.

This object is achieved with a sealing member of the type described above, made of a compressible material and with slits and/or weakening sections that extend into the sealing member from the exterior surface towards the interior surface, each slit and/or weakening section extending from one side surface to the other side surface.

In this context the term "compressible material" is to be understood as including materials, which will collapse at least partially under the weight of common roofing materials, including tiles, shale slates, cement-bound roof plates and metal roof plates, when used in an inclined or flat roof construction.

The slits and/or weakening sections will increase the ability of the sealing member to adapt to the roof structure and solve the problems associated with using a simple strip of insulation material described above by allowing different sections of the sealing material to be displaced in relation to each other and allow one section to be fully compressed below a tile or other roofing material, while the neighbouring section can remain in its original uncompressed shape. This is particularly advantageous at the joint between two pieces of roofing material, where there will often be a discontinuity on the interior side of the roofing due to the overlap between different pieces of roofing material. Specifically, the provision of the slits and/or weakening sections will prevent a section of the sealing material, which is being compressed below one tile or like piece of roofing material, from pulling the neighbouring section locate underneath a tile arranged above it in the roof construction and thus located further towards the exterior side of the construction, away from the tile. Another advantage is that the different sections of the sealing member may move sideways in relation to each other, i.e. transverse to the length direction, and allow a better adaptation to level differences in roofing material in the transverse directions, which are also typical in undulated tile roofs. This means that transverse displacement of one section will not result in a displacement of the entire sealing member.

Using slits will allow different sections of the compressible material to move virtually unimpeded, whereas weakening sections will first have to be broken before different sections can move in relation to each other. The strength of the weakening sections should therefore be chosen so that they break automatically where needed when the roofing material is applied.

In some embodiments, the sealing member may be provided with a combination of slits and weakening sections in order to impose particular properties on the sealing member. It is even possible to have a slit and a weakening section in the same plane, so that two neighbouring sections of the sealing member are separated by a slit at least at one part of the cross-section and interconnected by a weakening section at least at one other part of the cross-section. As an example a weakening section may extend in the height direction at the centre of the sealing member, while neighbouring sections are separated by slits at the side surfaces. In another embodiment, the sealing member is provided with slits at the exterior surface and with weakening sections closer to the interior surface so that less force will be needed to pull the neighbouring sections of the sealing member apart at the exterior surface than further down in the sealing member profile.

Whereas slits are easily provided by cutting the material, the provision of weakening sections may be somewhat more complex. Weakening sections may for example be provided by embedding zones of different materials, by providing zones with a lower material density or by locally weakening the material, for example by penetrating the material with needles. Weakening sections also includes sections, where the material of the sealing member has first been cut or otherwise separated and then loosely reconnected, for example by means of an adhesive or other fusion technique such as welding.

In a preferred embodiment, the slits and/or weakening sections extend in parallel planes, each plane being substantially parallel to the height direction and extending at an angle of 15-75 degrees to the length direction, preferably an angle of 30-60 degrees to the length direction, still more preferred at an angle of 45 degrees to the length direction. When the slits and/or weakening sections extend at a non-perpendicular angle to the length direction in this way, the risk of openings forming between neighbouring sections of the sealing member when one of them is being compressed is reduced. However, regardless of the orientation of the slits and/or weakening sections, there is still a risk that the compression results in the one or more of them being pulled slightly open. This provides a direct channel through the sealing member, which of course affects the sealing properties negatively, but the angled orientation of the slits and/or weakening sections reduces this effect as the angle will result in the formation of a labyrinth seal. In order to further reduce the effect it is also possible to use a material having two or more independent series of slits and/or weakening sections, which contribute further to the forming of the labyrinth. Alternatively, two or more separate sealing members may be arranged side-by-side and with slits/weakening sections off-set in relation to each other.

A further effect of the slits and/or weakening sections being angled is that a good balance is reached between the need for individual mobility of each section and the sealing member functioning as one member. Specifically, the angling means that neighbouring sections will to some extend follow each other due to contact between them, either in the form of friction or weakening sections remaining more or less intact, at least during a part of the movement following from the compression. This means that the different sections do not end up projecting in many different directions in an untidy manner, which may particularly be a problem where two different pieces of roofing material meet.

Still another advantage of the angled slits and/or weakening sections is that when using several different flashing members, which are arranged adjacent to each other, such as a top flashing member, a bottom flashing member and two side flashing members, an overlap between sealing members provided on different flashing members may easily be established. This will be explained further with reference to the drawing below.

In order to provide the desired adaptability of the sealing member, it is presently preferred that the slits and/or weakening sections extend over at least half of the height of the sealing member. The exact optimal extend of the slits and/or weakening sections will, however, depend on numerous factors such as the total height and width of the sealing member and the intended use of the sealing member.

It is to be understood that the optimal extend of slits and weakening sections need not be the same, that slits and weakening sections provided in the same sealing member need not have the same extend and that the extend of slits and/or weakening sections in a sealing member may vary over the length of the sealing member.

In some embodiments an interior part of the sealing member closest to the interior surface is without slits or weakening sections. This provides stability, not only with respect to its behaviour during compression but also during installation on a flashing member and other handling steps.

Having an interior part without slits or weakening sections also allows that removal of the exterior part of the sealing member leaving a simple strip of compressible material as described in EP1451422A1, thereby increasing the versatility of the product. For this purpose a weakening portion in the longitudinal direction, such as a cavity situated at a distance from the surfaces of the sealing member, may be provided as described in EP1451422A1.

In a preferred embodiment, the height of the interior part constitutes at least ⅕ of the height of the sealing member.

The slits should preferably be at least as deep as largest difference in height occurring in the roofing material in the mounted state, i.e. typically the depth of curvature of roofing material. If the sealing member is to be used with undulated roof plates or tiles, the sealing member preferably has a height in the height direction of 40-100 mm, more preferably 50-80 mm, still more preferred 60-75 mm. This corresponds with the undulated roofing materials most commonly used in northern Europe, which typically have an interior height of 50-60 mm, and it will be understood that different types of roofing materials may require different dimensions.

For most uses the distance in the length direction between neighbouring slits and/or weakening sections is 5-40 mm, preferably 5-30 mm, more preferred 10-20 mm, but here too the optimal dimension will depend on the intended use and the properties of the material used.

In some embodiments, the width of the sealing member is smaller at the exterior surface than at the interior surface. This contributes to the adaptability of both the sealing member as such and of the individual sections. If the sealing member is made with a symmetrical cross-sectional shape the risk of it being installed in a wrong orientation on the flashing member is reduced. It is presently preferred that the two side surfaces are converging in the height direction from the interior surface towards the exterior surface.

In a specific embodiment, the width of the interior part is substantially constant over its height and the width of the remaining exterior part of the sealing member decreases continuously towards the exterior surface, so that the interior part has a substantially rectangular cross-sectional shape and the exterior part has the cross-sectional shape of an isosceles trapezoid, possibly with rounded corners at the exterior surface.

The sealing member may be made by extrusion or a like continuous process and cut to length before use, which is particularly advantageous when using a foamed polymer, but it is also possible to cut it from a larger piece of material. Slits and or weakening sections may be formed simultaneously or subsequently.

It is also possible to make two or more sealing members integral with each other and then separate them before use. As an example, two sealing members may be formed at the same time and interconnected at the exterior surfaces. This results in the exterior surfaces of both sealing members being cut surface. When making the sealing members from a polymer by extrusion, moulding or a similar process a surface skin is usually formed on the sealing member, and the subsequent cutting of the material will result in the exterior surface having a different coefficient of friction than the side surfaces. This may reduce the tendency of the exterior to slide over the surface of the roofing material during compression and hence reduce the risk of sections of the sealing member moving to unintended positions during installation. Though here described with reference to the exterior surface, the basic idea of utilizing a combination of moulded and cut surface to achieve a desired combination of surface properties may be used with respect to other surfaces too and different parts of a surface may be given different properties. Likewise it will be understood that surface properties may be altered in other ways, including surface treatment of the sealing member.

It is in principle sufficient that the material used for the sealing member can be compressed to conform to the shape of the interior surface of the roofing. However, in order to allow the sealing member to stay in contact with the roofing over time, it is preferred that the material used is elastic, at least at room temperature. This will allow the material to follow movements in the roofing caused for example by thermal expansion and contraction, moisture related swelling and creep, and general subsidence of the construction.

As in EP1451422A1, the sealing member can be provided with lines or other markings allowing the height to be reduced by indicating where to cut or with tear-off a part of it.

It is presently preferred to make the sealing member from a foamed polymer, such as polyethylene, polyether or polyester. Low density polyethylene (LDPE) foam combines advantages with regards to handling, price and environmental consideration, but any other suitable material may be used.

In one embodiment, the sealing member is made from non-cross-linked LDPE with a density of approximately 20 $kg/m^3$.

In another embodiment the sealing member is made from a polyether/polyester foam with a density of approximately 25 $kg/m^3$.

A satisfactory compressibility have been found to correspond to a softness of less than 15 Kpa at 50% compression measured in accordance with ISO 386-1.

Needle penetration of non-cross-linked LDPE with a density of approximately 20 $kg/m^3$ has been found to result in the desired compressibility and has the advantage that different parts of the foam profile may be given different compressibility.

Further, preferred and independent properties are:

Tensile strength more than 200 KPa measured in accordance with ISO 1798-2008.

Less than 5% dimensional variation in thickness and width and less than 8% dimensional variation in length after 2 h at 70° C.

Compression set at 24 h and 50% compression after 24 h relief less than 10% at 20° C. and less than 45% at 50° C. measured in accordance with ISO 1856-C.

Water absorption over 7 days less than 3 vol. % measured in accordance with DIN 53428.

Regardless of the material used, is should have a high UV resistance and be tolerant to repeated freezing and thawing over an extended period of time.

Independent of other features, the sealing member may further include a fastening means for attaching the sealing member to a flashing member, said fastening means preferably being chosen from the group consisting of: adhesives, double sided tapes, hook-and-loop type fasteners, brackets, recesses or similar interlocking means matching members on the flashing member. Due to the structural simplicity it is presently preferred to use adhesives, such as a pressure sensitive adhesive applied during manufacture, a hot-melt adhesive or a double sided tape applied to the sealing member with a cover foil to be removed immediately prior to attachment. Other examples are interlocking means with matching members on the sealing member and the flashing member, so that the sealing member may be attached by snap-locking or by sliding interlocking parts into engagement. An example of a hook and loop type fastener is Velcro®.

The invention further relates to a flashing kit including a plurality of flashing members and at least one sealing member according to one or more of claims 1-12. The flashing members are adapted for being arranged along top, bottom and sides of a roof penetrating structure, such as a roof window, each flashing member having an exterior side adapted for facing the exterior of a building in the mounted state and an interior side adapted for facing the interior of the building in the mounted state, and each flashing member including a first leg adapted for lying substantially in the plane of the roof between a load-bearing structure and a roofing material and a second leg extending at an angle with respect to the first leg and adapted for lying substantially parallel to an outer side of the roof penetrating structure projecting over the load-bearing structure. The at least one sealing member is attached to the exterior side of at least one flashing member or adapted for being attached to the exterior side of at least one flashing member during installation of the flashing kit. The fasteners mentioned above for attaching the sealing member to the flashing member may also be employed here.

In a preferred embodiment the flashing kit comprises a top flashing member, a bottom flashing member and two side flashing members adapted for being arranged along the top, bottom and sides of the roof penetrating structure, respectively, and a sealing member according to one or more of claims 1-12 are found on two or more of these flashing members.

Sealing members on flashing members adapted for being arranged side-by-side or in an overlapping manner are preferably arranged so that they will be located in continuation of each other in the mounted state.

In some embodiments, the sealing members are arranged so that they project over the edge of the flashing member in order to be able to come into contact with or overlap a sealing member on another flashing member in the mounted state.

A second aspect of the invention relates to a method for weather proofing the joint between a roof of a building and a roof penetrating structure, comprising the following steps, which are not necessarily to be performed in the sequence:

arranging at least one flashing member on a load-bearing structure of the roof with an exterior side facing the exterior of the building and an interior side facing the interior of the building, and with a first leg lying substantially in the plane of the roof between a load-bearing structure and a roofing material and a second leg extending at an angle with respect to the first leg and lying substantially parallel to an outer side of the roof penetrating structure projecting over the load-bearing structure, arranging a sealing member on the at least one flashing member with an interior surface attached to the flashing member, said sealing member further having two side surfaces extending between the interior surface and an exterior surface opposite the interior surface, a height direction extending from the interior surface to the exterior surface, a length direction extending in parallel to the exterior surface, the interior surface and the side surfaces, and a width direction extending between the two side surfaces perpendicular to the height direction and the length direction, and where slits and/or weakening sections extend into the sealing member from the exterior surface towards the interior surface, each slit and/or weakening section extending from one side surface to the other side surface, arranging a roofing material on the load-bearing structure so that the first leg of the flashing member projects under the roofing material in the mounted state and so that the roofing material rests on the sealing member and compresses one or more sections of the sealing member.

It is noted that the sealing member does not need to be in direct contact with the flashing member, but that it should be ensured that it stays in the intended position.

In order to avoid erroneous installation it is preferred that the sealing member(s) is/are fastened to the flashing member (s) before arranging the flashing member(s) on the load-bearing structure.

Even though the sealing member may be used at all sides of a roof penetrating structure it will often not be the case. As an example there is usually no need for a sealing member of this type below a roof window mounted in an inclined roof and seen in the direction of slope. It should also be understood that the sealing member according to the invention may be used in combination with other types of sealing members, for example only at the sides of a roof window, while prior art sealing members are used at the top of the window.

When using the sealing member according to the invention with a roof penetrating structure having a rectangular shape, such as a roof window or solar panel, separate sealing members may be arranged to abut each other at the corners or a longer the sealing member may be bent to come around corner. It is, however, also possible to use separate corner sealing members.

Even though the use of the sealing member is here described primarily with relation to a roof window, it will be understood that it may also be used with solar panels, façade windows etc.

Figure 1B:
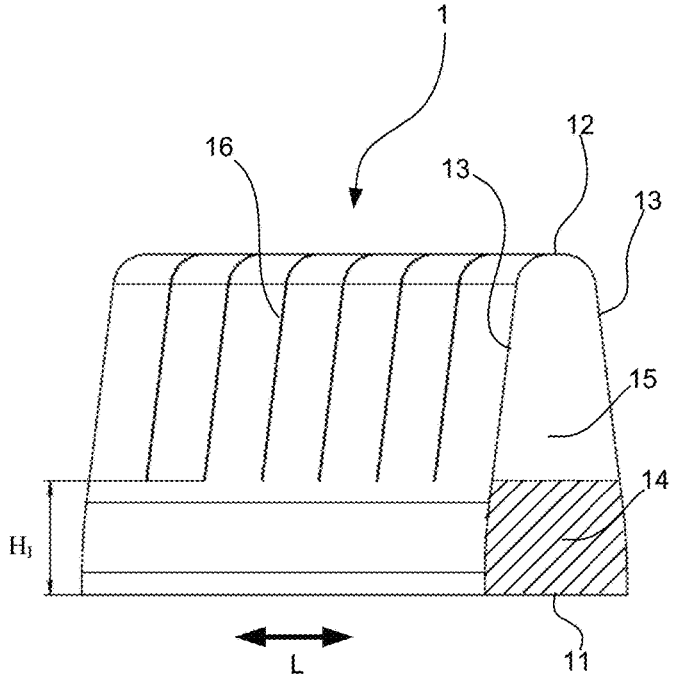
Figure 1C:
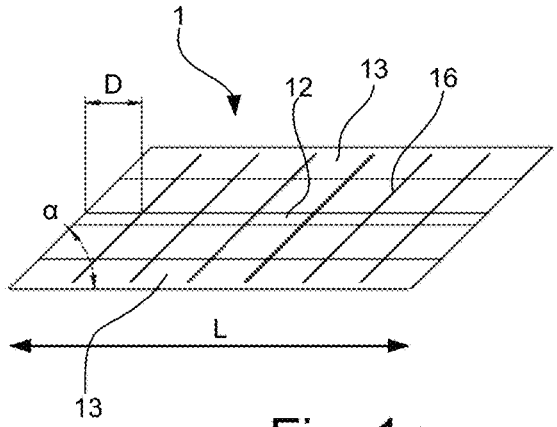
Figure 2A:
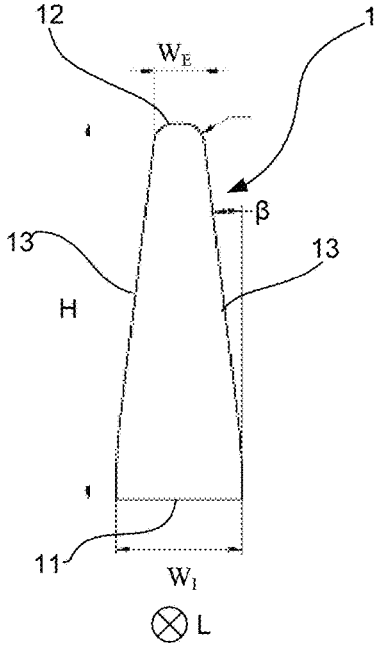
Figure 2B:
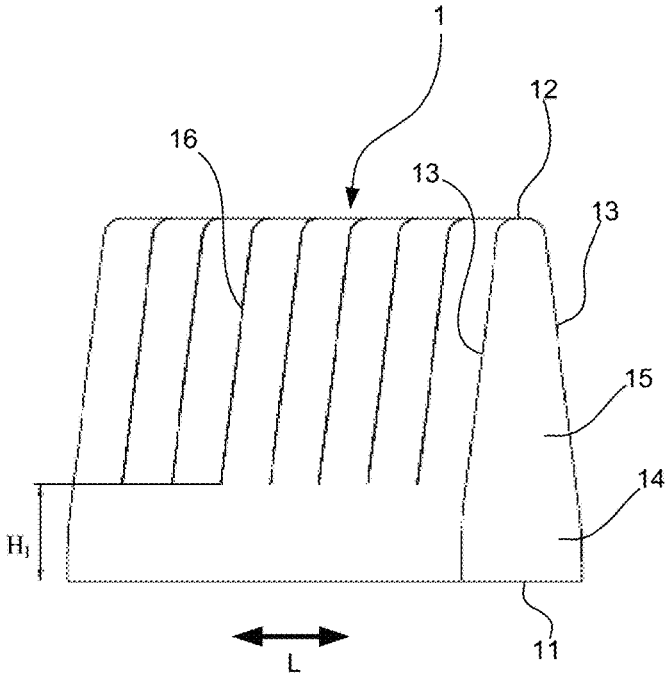
Figure 2C:
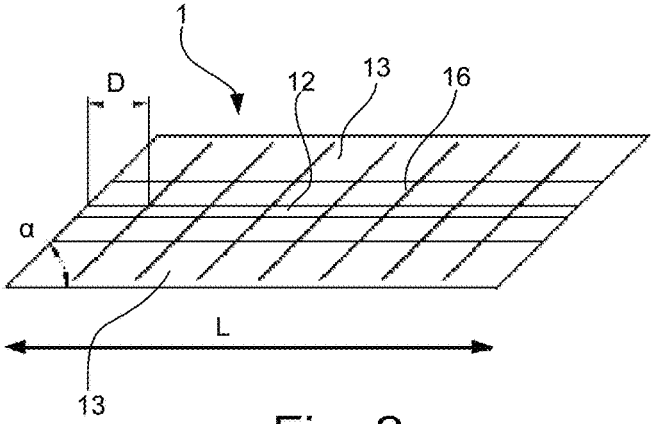
Figures 3A, 3B, 3C, 3D, 3E:
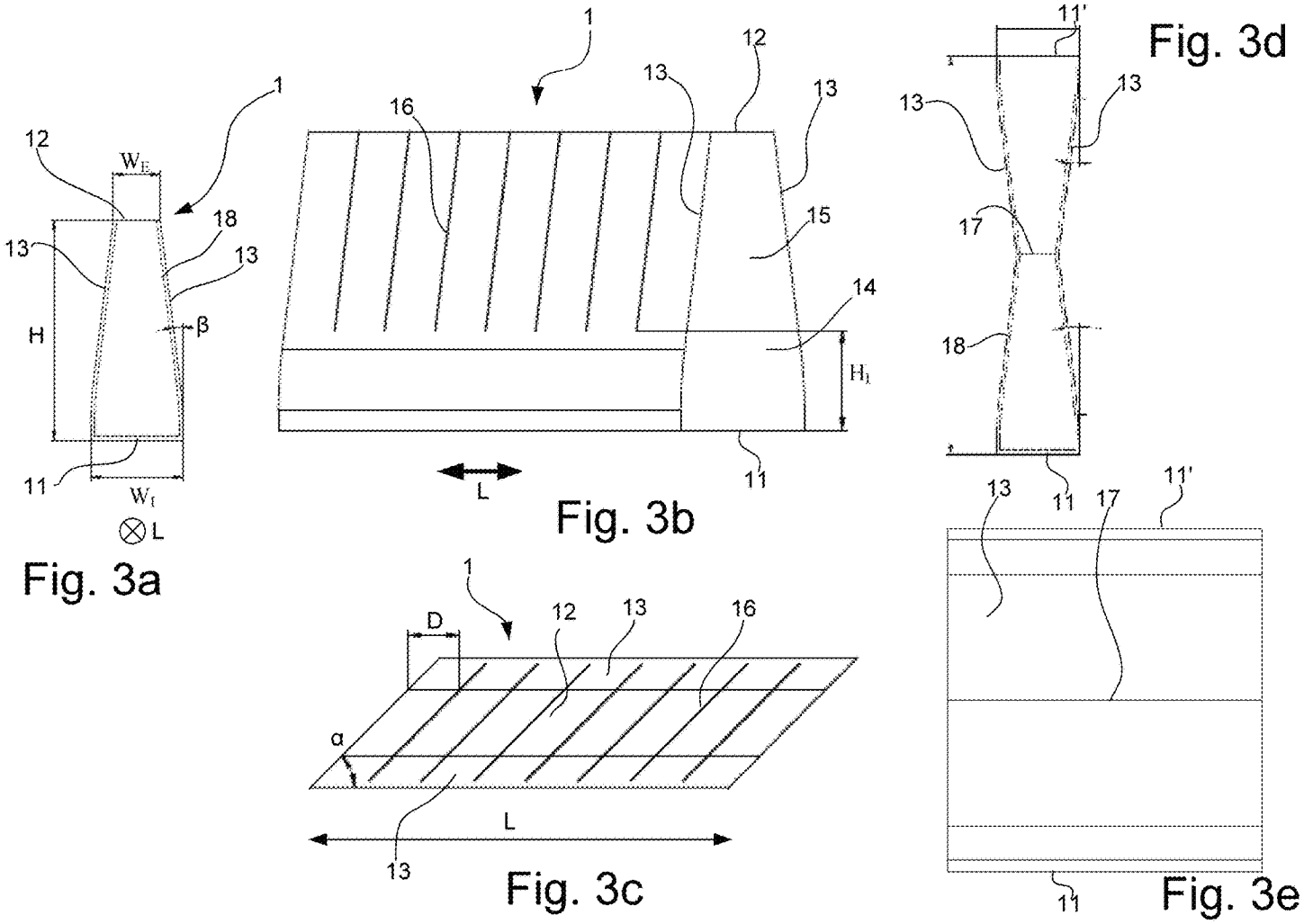

In the following the sealing member according to the invention will be described in further detail with reference to embodiments shown on the accompanying drawing, where:

FIG. 1*a* shows an end view of a first embodiment of a sealing member according to the invention, FIG. 1*b* shows the sealing member in FIG. 1*a* from the side, FIG. 1*c* shows the sealing member in FIGS. 1*a* and 1*b* from above, FIG. 2*a* shows an end view of a second embodiment of a sealing member according to the invention, FIG. 2*b* shows the sealing member in FIG. 2*a* from the side, FIG. 2*c* shows the sealing member in FIGS. 2*a* and 2*b* from above, FIG. 3*a* shows an end view of a third embodiment of a sealing member according to the invention, FIG. 3*b* shows the sealing member in FIG. 3*a* from the side, FIG. 3*c* shows the sealing member in FIGS. 3*a* and 3*b* from above, FIG. 3*d* is an end view of an intermediate product in the manufacture of the sealing member in FIGS. 3*a*-3*c*

Figure 4A:
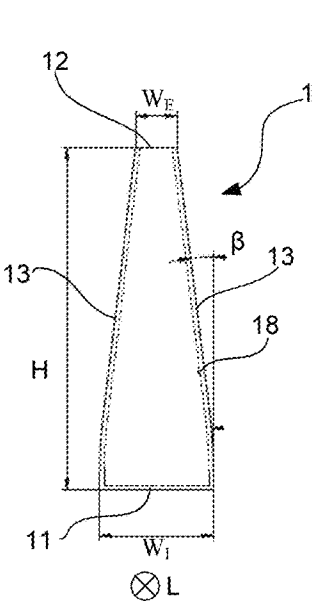
Figure 4B:
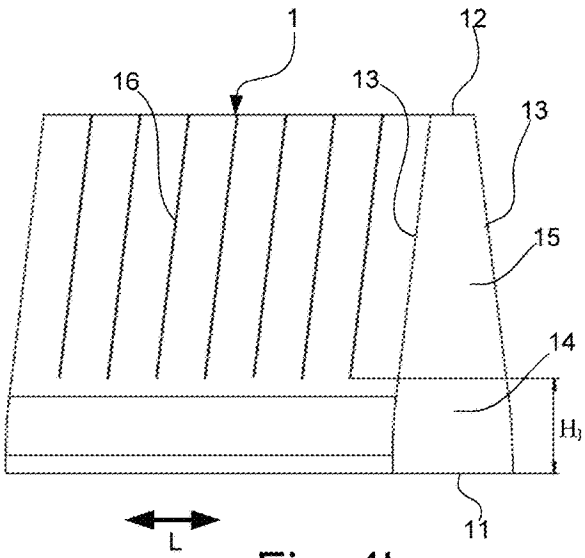
Figure 4C:
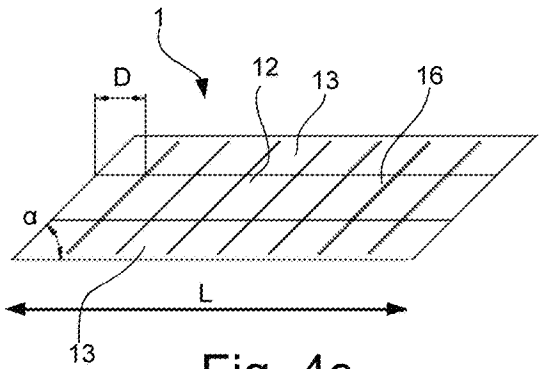
Figure 4D:
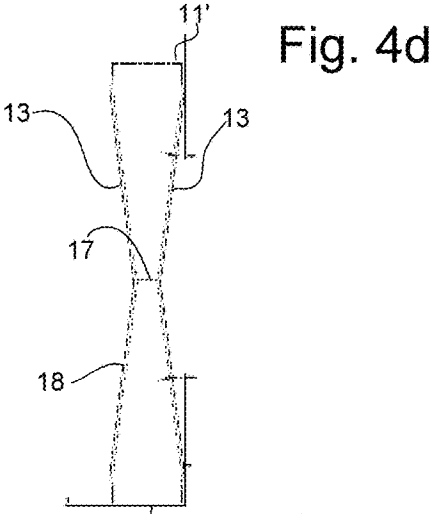

FIG. 3*e* shows the intermediate product in FIG. 3*d* from the side,

FIG. 4*a* shows an end view of a fourth embodiment of a sealing member according to the invention, FIG. 4*b* shows the sealing member in FIG. 4*a* from the side, FIG. 4*c* shows the sealing member in FIGS. 4*a* and 4*b* from above, FIG. 4*d* is an end view of an intermediate product in the manufacture of the sealing member in FIGS. 4*a*-4*c*

Figure 4E:
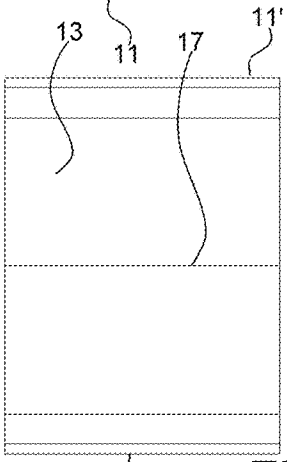
Figure 5:
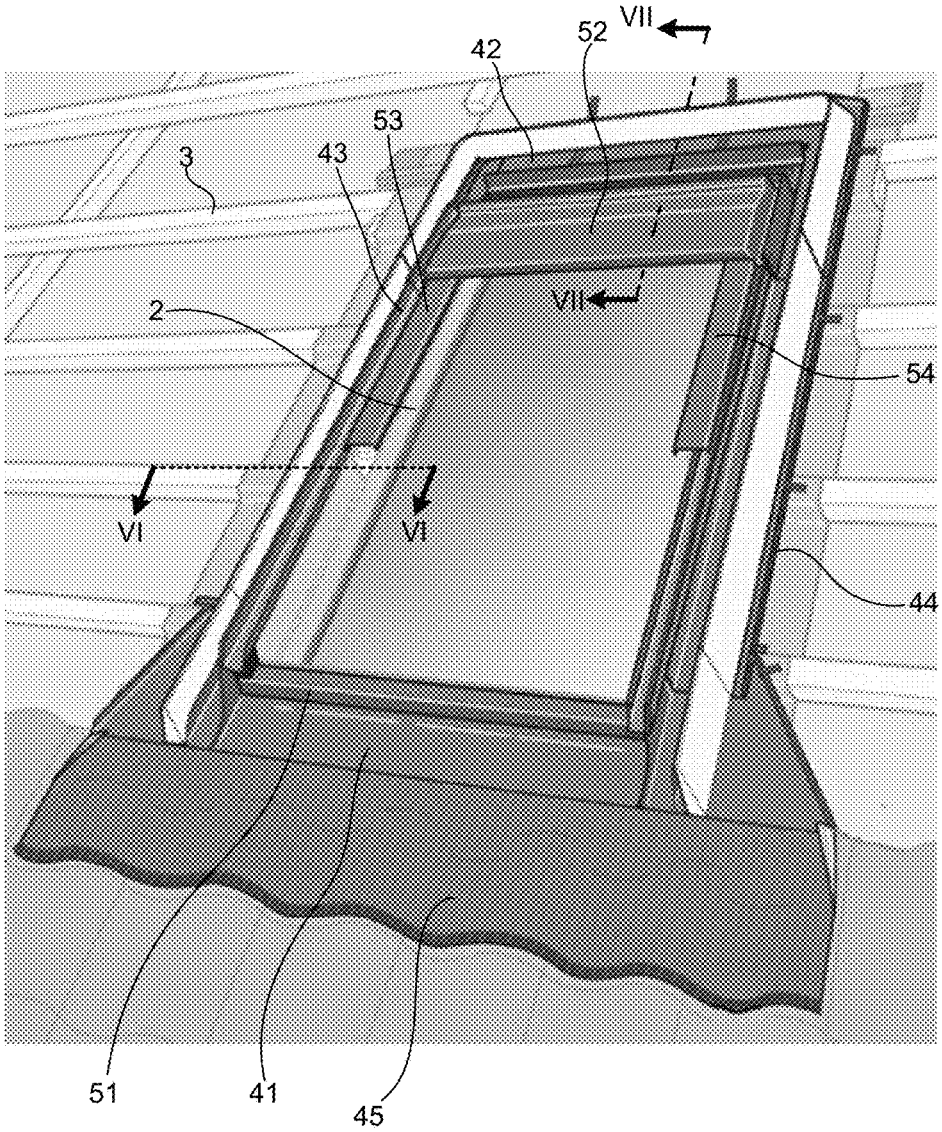
Figure 8:
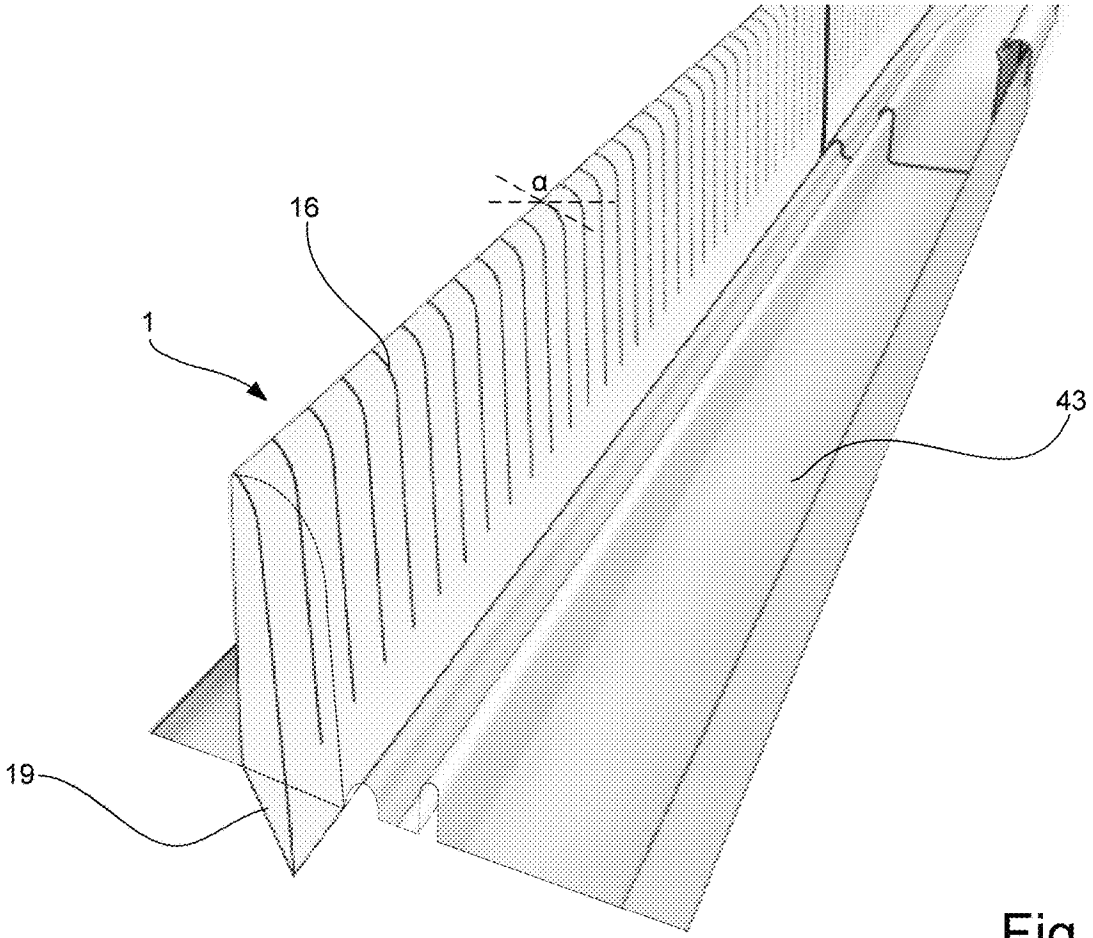
Figure 9:
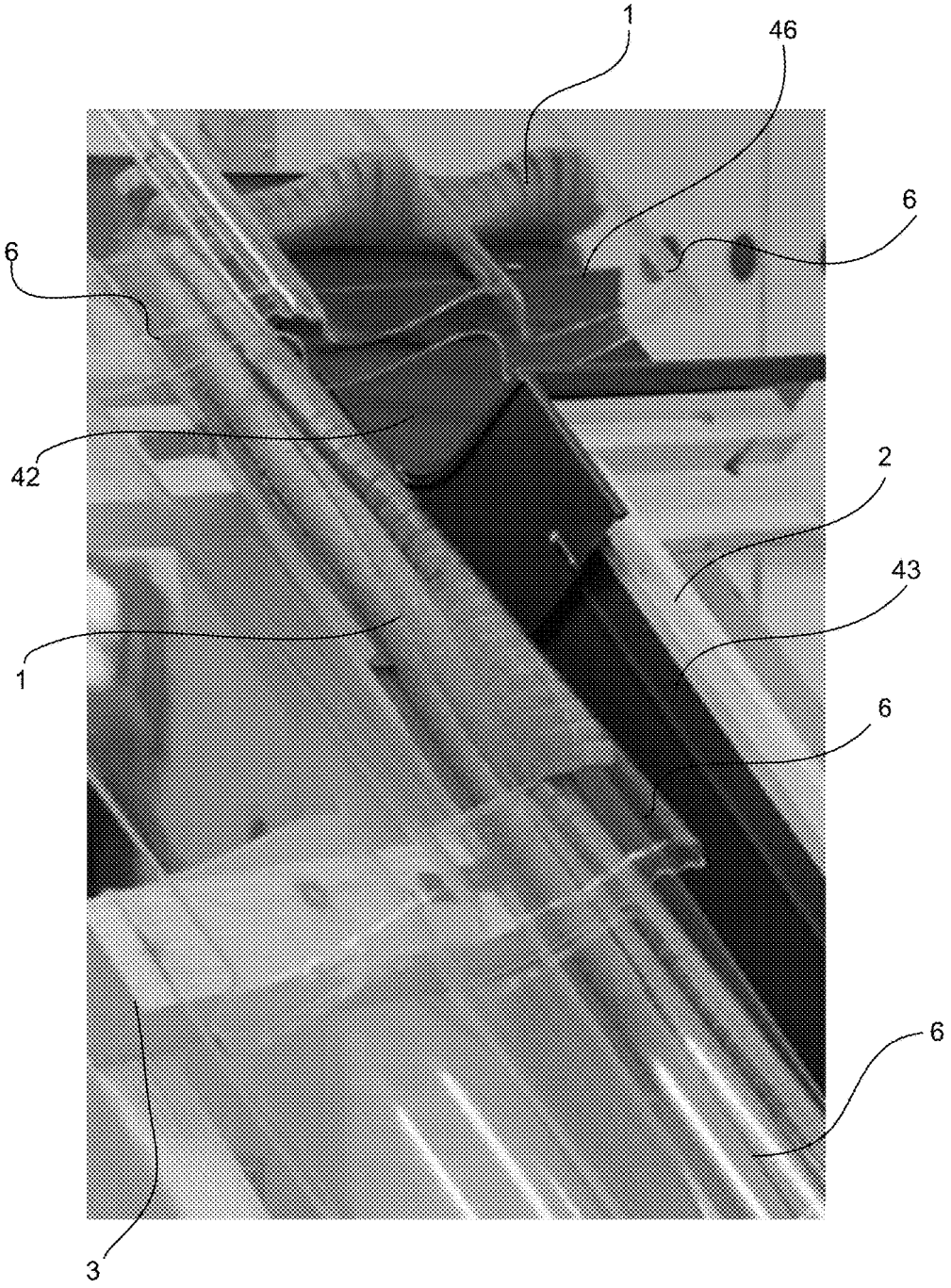

FIG. 4*e* shows the intermediate product in FIG. 4*d* from the side,

FIG. 5 shows a roof penetrating structure mounted with a flashing kit according to the invention in a perspective view, FIG. 6*a* is a cross-sectional view along the line VI-VI in FIG. 5, but with a first type of roof tile added, FIG. 6*b* is a cross-sectional view along the line VI-VI in FIG. 5, but with a second type of roof tile added, FIG. 7 is a cross-sectional view along the line VII-VII in FIG. 5, but with a roof tile added, FIG. 8 shows a sealing member according to the invention fastened to a side flashing member and the connection to another flashing member with a sealing member in a perspective view, and FIG. 9 is a photo of a test installation of a flashing kit according to the invention using the upper right-hand corner of a roof window frame and transparent plastic tiles.

Throughout the drawing like reference numbers have been used for parts having similar or analogous function, but this is not to be taken as an indication that such parts found in different figures are necessarily identical.

The sealing member shown in FIGS. 1*a*-1*c* and generally designated 1 has a substantially elongated shape and a pre-defined cross section which is substantially uniform in the length direction L. An interior surface 11 is adapted to abut on a flashing member (not shown), an exterior surface 12 is adapted to face the exterior of a building, and two side surfaces 13 interconnects the interior and exterior surfaces. It is noted that the deformation of the sealing member, which occurs when the sealing member is compressed under the weight of a roofing material as will be described later, may result in the exterior surface being tilted to a different orientation and that the orientation towards the exterior explained above may therefore only by found in the non-compressed state.

In the embodiment shown the sealing member 1 includes an interior part 14, which is hatched in FIG. 1*c*, and an exterior part 15. The interior part 14 is substantially homogeneous, uninterrupted and with a rectangular cross-sectional shape. The exterior part 15 is provided with slits and/or weakening sections 16 extending from the exterior surface 12 to the interior part 14 and from one side surface 13 to the other. Here the height $H_I$ of the interior part constitutes ⅓ of the total height H of the sealing member.

As may be seen in FIGS. 1*b* and 1*c* the slits and/or weakening sections 16 are located in parallel planes, each plane being substantially parallel to the height direction H and extending at an angle $\alpha$ of 45 degrees to the length direction L. This angle in combination with the cross-sectional shape being symmetrical has been found to be advantageous as it does then not matter if the sealing member is turned one way or the other, but other angles may be employed and may even allow the different sections of the sealing member to easier adapt to the shape of the roofing material.

The distance D in the length direction between neighbouring slits and/or weakening sections is 10 mm in FIGS.

1*b* and 1*c*, but it may be advantageous to divide the sealing member into smaller or larger sections depending for example on the dimensions of the roofing material pieces to be used.

Both slits and weakening sections 16 may be made by cutting or melting the material or by any other process resulting in an interruption of the material, the difference being if the material is interrupted entirely or only partially.

Here the entire sealing member 1 is made from the same material, but in other embodiments different parts may have different density and/or different structure and/or be made from different materials. A transition between different parts with different material properties may be gradual or abrupt and does not necessarily have to be located at the level where the slits and/or weakening sections end.

In other embodiments weakening sections 16 are provided as sections of a weaker material than the rest of the sealing member 1. Such weakening sections will typically have a slightly larger thickness in the length direction L than those shown in FIGS. 1*b* and 1*c*. For the sake of clarity the relatively thin lines used to depict the slits and/or weakening sections in FIGS. 1 and 1*c* will also be used in other figures, but it will be understood that these may also represent weakening sections of a somewhat larger extend.

The side surface 13 converge towards the exterior surface 12, here with an angle β of 7 degrees, so that the width $W_E$ at the exterior surface is smaller than the width $W_I$ at the interior surface.

The embodiment shown in FIGS. 1*a*-1*c* is intended for use with a roof window mounted in a standard configuration in a roof covered with undulated tiles. In some cases, however, the distance between the flashing members used along the outer sides of the roof window and the roofing material is larger and a higher sealing member is then needed. Such a sealing member is shown in FIGS. 2*a*-2*c*. As will be seen, this sealing member is substantially identical to the one described with reference to FIGS. 1*a*-1*c* except for the exterior part 15 being higher and the width $W_E$ at the exterior surface being somewhat smaller, and this sealing member will therefore not be described in further detail.

Another embodiment of a sealing member 1 is shown in FIGS. 3*a*-3*c*. As will be seen, this embodiment different from the one in FIGS. 1*a*-1*c* in that the exterior surface 12 is substantially flat instead of rounded. Such a shape may be achieved by moulding or extrusion, which are the preferred methods for manufacturing the sealing members shown in FIGS. 1 and 2, but in the present case it has been achieved by making two sealing members simultaneously and interconnected as shown in FIGS. 3*d* and 3*e*, and then separating them by cutting. The cut line 17 then forms the exterior surfaces 12 of the two resulting sealing members. In the embodiment shown the slits and/or weakening sections 16 are not yet provided in the intermediate product shown in FIGS. 3*d* and 3*e*, but are provided either simultaneous with the separation step or subsequently. They could, however, also be made in connection with the moulding or extrusion process, particularly if using weakening sections of a different material as described above.

When making the sealing members from a foamed polymer by moulding or extrusion, the process will usually result in the formation of a skin layer with a slightly higher density than the rest of the profile. This skin layer has been indicated by the broken line 18 in FIGS. 3*a* and 3*d*. When separating the intermediate product in FIGS. 3*d* and 3*e* into two sealing members, the skin layer will be found only on the interior surfaces 11, 11' and side surfaces 13, whereas the interior of the material will be exposed at the exterior surface 12. This usually results in the exterior surface having a more open structure and a higher coefficient of friction then the other surfaces. The skin layer is generally being considered advantageous as it increases the weather resistances and makes it harder for dirt to adhere to the surface, but as the exterior surface will be in contact with or at least well protected underneath the roofing material, the advantages of having an exterior surface with a higher coefficient of friction, which will be described below, is presently considered to outweigh the disadvantage of interrupting the skin layer.

While the embodiment shown in FIGS. 3*a*-3*e* is intended for use with a roof window mounted in a standard configuration in a roof covered with undulated tiles in the same way as the sealing member in FIGS. 1*a*-1*c*, the embodiment shown in FIGS. 4*a*-4*e* is intended to serve the same purpose as the embodiment in FIGS. 2*a*-2*c*. As described with references to FIGS. 1 and 2, the embodiments in FIGS. 3 and 4 differ only with respect to height of the exterior part 15 and the width $W_E$ at the exterior surface, and the embodiment in FIGS. 4*a*-4*e* will therefore not be described in further detail.

Turning now to FIG. 5 a roof window frame 2 is shown mounted in the load-bearing construction 3 of an inclined roof. The window frame is surrounded by a flashing frame 4, which includes four flashing members 41-44, each having a first leg lying substantially in the plane of the roof and a second leg extending at an angle with respect to the first leg covering a part of the outer side of the window frame, and which is partly overlapped by cover members 51-54. Each flashing member 41-44 is provided with a sealing member 1 of the types shown in FIGS. 4*a*-4*c*, which is here shown without the slits and/or weakening sections for the sake of simplicity. At the intersection between adjoining flashing members, the flashing members may be connected with each other in any suitable manner, e.g. by folding, welding or by any other method and the same applies to the cover members. In FIG. 5 the flashing members are shown with integrated corner sections, but it is also possible to provide a plurality of separate flashing corner members for connection of adjoining flashing members. Water gathered at the top of the window is led down along the sides of the window and further down to the roofing below the window via a skirt 45 in a manner known per se.

Here the flashing is composed of several members, but a unitary flashing may of course also be utilized, just as the number and arrangement of cladding and covering members may vary. Likewise, the sealing members 1 may in principle have any extent in the longitudinal direction, but it is advantageous if the sealing member extends over substantially the entire length of the corresponding flashing member as shown in FIG. 5, and it is even possible to let one sealing member extend over two or more flashing members.

FIGS. 6*a* and 6*b* show two different cross-sectional perspective views along the line VI-VI in FIG. 5, where a roof tile 6 has been arranged on top of the load-bearing structure 3 and the sealing member 1 so that the sealing member has been compressed under its weight. In FIG. 6*a* the space underneath the roof tile 6 is larger due to the curvature of the tile and the sealing member 1 has remained substantially in its original shape. In FIG. 6*b* on the other hand the tile 6 curves downwards towards flashing member 43 and has therefore compressed the sealing member 1 almost entirely.

The situation at the top, above the window frame is shown in FIG. 7, which is a cross-sectional perspective view along the line VII-VII in FIG. 5. As may be seen the tile 6 is here kept at a distance above the top flashing member 42 by resting on a tile support rail 46 and the sealing member 1 is therefore less compressed than in FIG. 6*b*. It will, however, be understood that due to the curvature of the roof tile 6, the sealing member will be even less compresses at other sections, where the tile curves upwards towards the exterior.

A sealing member 1 with slit and/or weakening section planes 16 arranged at an angle α of 45 degrees is shown on a side flashing member 43 in FIG. 8. The end of the sealing member is cut in the same angle as the slits and/or weakening sections and has been arranged on the flashing member so that the end part 19, which is of a non-constant cross-sectional shape and delimited by the imaginary broken lines in FIG. 8, projects over the end of the flashing member. This allows the end part 19 to project over the edge of another flashing member and provide an overlap with a similar sealing member on an adjacent flashing member (not shown). It is, however, also possible to let the sealing member 1 end at level with the end of the flashing member 43 and instead let a sealing member on the adjacent flashing project upwards to provide the overlap, or to allow only half of the triangular end part 19 on both sealing members to project so that they both contribute to an overlap.

Turning now to FIG. 9 the upper right-hand corner of a roof window frame 2 is shown mounted in an inclined load-bearing structure 3 with flashing members 42, 43, 46. Sealing members 1 are attached to the top flashing member 43 and the side flashing member 43 and a roofing of transparent undulated plastic tiles 6 have been laid on top of them. The sealing members used in this case are with slits arranged at an angle α of 75 degrees to the length direction, i.e. close to perpendicular to the length direction.

As may be seen the sealing member 1 on the top flashing member 42 has been compressed in an undulated pattern corresponding to the curvature of the roofing material 6. At the points where the sealing member is least compressed the slits have slightly opened at the exterior surface thereby allowing the sealing member to easily adapt to the shape of the tiles, but the angling of the slits ensure that the sealing remains substantially intact.

In this embodiment, the sealing member extending along the side flashing member 43 has been made extra long so that it also extends over the top flashing member 42 up to the level of the sealing member extending horizontally thereon. In other embodiments, the top flashing member 42 would be provided with a sealing member extending in continuation of the sealing member on the side flashing member 43, possibly a single sealing member extending horizontally and then being bent over 90 degrees to come down along one or both sides towards the side flashing member(s) as shown in FIG. 5.

The compression of the sealing member on the side flashing member 43 has resulted in the sections of the sealing underneath the uppermost part of each tile 6 being compressed almost to its maximum, while the sections underneath the lowermost part of each tile is just slight bent in a downwards direction.

In this case the compression of the sections of the sealing member 1 underneath the uppermost part of each tile 6 has resulted in the exterior part of the sealing member 1 not only being compressed but also having tilted in direction away from the window frame 2. This need not be a problem, but with some types of sealing members it may result in unsatisfactory sealing properties. In order to reduce the risk of such sideways tilting the angle β may be adjusted, but as the tilting is at least partly caused by the sealing member sliding over the surface of the roofing material during compression, it is also possible to increase friction between the roofing material and the sealing member. This may be done by a surface treatment of the sealing member, but will easily be achieved by providing the exterior surface as a cut surface as described above with reference to FIGS. 3*d*, 3*e*, 4*d* and 4*e*.

The invention should not be regarded as being limited to the embodiments shown. On the contrary, various modifications and combinations of the features shown will be within the scope of the invention.

The invention claimed is:

1. A flashing kit for use in the installation of a roof penetrating structure in an inclined roof surface, comprising a plurality of flashing members adapted for being arranged along top, bottom and sides of a roof penetrating structure, such as a roof window, each flashing member having an exterior side adapted for facing the exterior of a building in the mounted state and an interior side adapted for facing the interior of the building in the mounted state, and each flashing member including a first leg adapted for lying substantially in the plane of the roof between a load-bearing structure and a roofing material and a second leg extending at an angle with respect to the first leg and adapted for lying substantially parallel to an outer side of the roof penetrating structure projecting over the load-bearing structure, and at least one sealing member having an interior surface and an exterior surface and two side surfaces extending between the exterior surface and the interior surface, said sealing member having a height direction extending from the interior surface to the exterior surface, a length direction extending in parallel to the exterior surface, the interior surface and the two side surfaces, and a width direction extending between the two side surfaces perpendicular to the height direction and the length direction, the sealing member is made of a compressible material and that slits and/or weakening sections extend into the sealing member from the exterior surface towards the interior surface, each slit and/or weakening section extending from one side surface to the other side surface, wherein the slits and/or weakening sections extend in parallel planes, each plane being substantially parallel to the height direction and extending at an angle of 15-75 degrees to the length direction, said sealing member being attached to the exterior side of at least one flashing member or adapted for being attached to the exterior side of at least one flashing member during installation of the flashing kit.

2. A flashing kit according to claim 1, characterized in that the slits and/or weakening sections extend over at least half of the height of the sealing member.

3. A flashing kit according to claim 1, characterized in that an interior part of the sealing member closest to the interior surface is without slits or weakening section.

4. A flashing kit according to claim 3, characterized in that the height of the interior part constitutes at least ⅕ of the height of the sealing member.

5. A flashing kit according to claim 1, characterized in that the sealing member has a height in the height direction of 40-100 mm, and/or that the distance in the length direction between neighbouring slits and/or weakening sections is 5-40 mm.

6. A flashing kit according to claim 5, characterized in that the width of the interior part is substantially constant over its height and that the width of the remaining exterior part of the sealing member decreases continuously towards the exterior surface.

7. A flashing kit according to claim 1, characterized in that the width of the sealing member is smaller at the exterior surface than at the interior surface.

8. A flashing kit according to claim 1, characterized in that the sealing member is made by extrusion or a continuous process and cut to length before use.

9. A flashing kit according to claim 1, characterized in that said sealing member was made integral with another sealing member and that the exterior surface is a cut surface where said sealing member was originally interconnected to said another sealing member.

10. A flashing kit according to claim 1, characterized in that said sealing member is made from an elastic material.

11. A flashing kit according to claim 1, further comprising a fastening means for attaching the sealing member to a flashing member, said fastening means being chosen from the group consisting of: adhesives, double sided tapes, hook-and-loop type fasteners, brackets, recesses or similar interlocking means matching members on the flashing member.

12. A flashing kit according to claim 1, characterized in that it comprises a top flashing member, a bottom flashing member and two side flashing members adapted for being arranged along the top, bottom and sides of the roof penetrating structure, respectively, and that the sealing is found on two or more of these flashing members.

13. A flashing kit according to claim 1 wherein the sealing member has a height in the height direction of 50-80 mm and/or that the distance in the length direction between neighbouring slits and/or weakening sections is 5-30 mm.

14. A flashing kit according to claim 1 the sealing member has a height in the height direction of 60-75 mm and/or that the distance in the length direction between neighbouring slits and/or weakening sections is 10-20 mm.

15. A flashing kit according to claim 1 wherein each plane extends at an angle of 30-60 degrees to the length direction.

16. A flashing kit according to claim 1 wherein each plane extends at an angle of 45 degrees to the length direction.

17. A method for weather proofing the joint between a roof of a building and a roof penetrating structure, comprising the following steps:

arranging at least one flashing member on a load-bearing structure of the roof with an exterior side facing the exterior of the building and an interior side facing the interior of the building, and with a first leg lying substantially in the plane of the roof between a load-bearing structure and a roofing material and a second leg extending at an angle with respect to the first leg and lying substantially parallel to an outer side of the roof penetrating structure projecting over the load-bearing structure, arranging a sealing member on the at least one flashing member with an interior surface attached to the flashing member, said sealing member further having two side surfaces extending between the interior surface and an exterior surface opposite the interior surface, a height direction extending from the interior surface to the exterior surface, a length direction extending in parallel to the exterior surface, the interior surface and the side surfaces, and a width direction extending between the two side surfaces perpendicular to the height direction and the length direction, and where slits and/or weakening sections extend into the sealing member from the exterior surface towards the interior surface, each slit and/or weakening section extending from one side surface to the other side surface, wherein the slits and/or weakening sections extend in parallel planes, each plane being substantially parallel to the height direction and extending at an angle of 15-75 degrees to the length direction, arranging a roofing material on the load-bearing structure so that the first leg of the flashing member projects under the roofing material in the mounted state and so that the roofing material rests on the sealing member and compresses one or more sections of the sealing member.

18. A method according to claim 17 wherein each plane extends at an angle of 30-60 degrees to the length direction.

19. A method according to claim 17 wherein each plane extends at an angle of 45 degrees to the length direction.

20. A method according to claim 17, characterized in that the slits and/or weakening sections extend over at least half of the height of the sealing member.

21. A method according to claim 17, characterized in that an interior part of the sealing member closest to the interior surface is without slits or weakening section.

22. A method according to claim 21, characterized in that the height of the interior part constitutes at least ⅕ of the height of the sealing member.

23. A method according to claim 22, characterized in that the width of the interior part is substantially constant over its height and that the width of the remaining exterior part of the sealing member decreases continuously towards the exterior surface.

24. A method according to claim 17, characterized in that the sealing member has a height in the height direction of 40-100 mm, and/or that the distance in the length direction between neighbouring slits and/or weakening sections is 5-40 mm.

25. A method according to claim 24 wherein the sealing member has a height in the height direction of 50-80 mm and/or that the distance in the length direction between neighbouring slits and/or weakening sections is 5-30 mm.

26. A method according to claim 24 wherein the sealing member has a height in the height direction of 60-75 mm and/or that the distance in the length direction between neighbouring slits and/or weakening sections is 10-20 mm.

27. A method according to claim 17, characterized in that the width of the sealing member is smaller at the exterior surface than at the interior surface.

28. A method according to claim 17, characterized in that the sealing member is made by extrusion or a continuous process and cut to length before use.

29. A method according to claim 17, characterized in that said sealing member was made integral with another sealing member and that the exterior surface is a cut surface where said sealing member was originally interconnected to said another sealing member.

30. A method according to claim 17, characterized in that said sealing member is made from an elastic material.

* * * * *